US012669054B2

(12) United States Patent
Guanziroli et al.

(10) Patent No.: US 12,669,054 B2
(45) Date of Patent: Jun. 30, 2026

(54) WORK CARRIAGE FOR THE LINING OF TUNNELS

(71) Applicant: HINFRA S.R.L., Casale Monferrato (Alessandria) (IT)

(72) Inventors: Stefano Guanziroli, Erba (Como) (IT); Francesco Guanziroli, Erba (Como) (IT)

(73) Assignee: HINFRA S.R.L., Casale Monferrato (IT)

( * ) Notice: Subject to any disclaimer, the term of this patent is extended or adjusted under 35 U.S.C. 154(b) by 52 days.

(21) Appl. No.: 18/840,097

(22) PCT Filed: Feb. 16, 2023

(86) PCT No.: PCT/IB2023/051394

§ 371 (c)(1),
(2) Date: Aug. 21, 2024

(87) PCT Pub. No.: WO2023/156925

PCT Pub. Date: Aug. 24, 2023

(65) Prior Publication Data

US 2025/0163806 A1 May 22, 2025

(30) Foreign Application Priority Data

Feb. 21, 2022 (IT) ..... 102022000003116

(51) Int. Cl.
*E21D 11/10* (2006.01)

(52) U.S. Cl.
CPC ..... *E21D 11/102* (2013.01); *E21D 11/105* (2013.01)

(58) Field of Classification Search
CPC ..... E21D 11/04; E21D 11/102; E21D 11/105; E21D 11/107; E21F 15/08
See application file for complete search history.

(56) References Cited

U.S. PATENT DOCUMENTS 4,222,681 A * 9/1980 Khodosh ..... E21D 9/0607 405/141
4,437,788 A * 3/1984 Walbrohl ..... E21D 11/102 405/141

(Continued)

FOREIGN PATENT DOCUMENTS

| | | |
|---|---|---|
| JP | 2007-138591 | 6/2007 |
| JP | 2007-138592 | 6/2007 |
| JP | 2014-005719 | 1/2014 |

OTHER PUBLICATIONS

International Search Report and the Written Opinion Dated May 22, 2023 From the International Searching Authority Re. Application No. PCT/IB2023/051394. (10 Pages).

*Primary Examiner* — Benjamin F Fiorello

(57) ABSTRACT

A work carriage running stepwise along a tunnel to lay a solidifiable fluid material on walls of the tunnel and allow it to solidify for constructing a tunnel lining is provided. The work carriage has a sliding formwork equipped with a closing board for closing, radially to the tunnel, a space between a front edge of the sliding formwork and a wall of the tunnel to be lined to form an interspace for accommodating the solidifiable fluid material against the wall of the tunnel. The sliding formwork has a covering mantle. A releasable constraint provided between the sliding formwork and the covering mantle switches from a first condition, in which the covering mantle is fixed to the sliding formwork, to a second condition, in which the covering mantle slides over the sliding formwork.

13 Claims, 5 Drawing Sheets

(56) References Cited

U.S. PATENT DOCUMENTS

| | | | | | |
|---|---|---|---|---|---|
| 4,451,176 | A * | 5/1984 | Flocke | E21D 9/06 | 405/150.2 |
| 4,768,898 | A * | 9/1988 | Babendererde | E21D 11/102 | 405/150.1 |
| 4,769,192 | A * | 9/1988 | Cerutti | E21D 11/102 | 264/33 |
| 4,799,824 | A * | 1/1989 | Kumai | E21D 11/10 | 249/11 |
| 5,253,955 | A * | 10/1993 | Walbrohl | E21D 11/102 | 264/32 |
| 5,267,814 | A * | 12/1993 | Yoshida | E21B 33/13 | 405/150.1 |
| 5,269,628 | A * | 12/1993 | Walbrohl | E21D 9/0692 | 405/145 |
| 9,945,229 | B2 * | 4/2018 | Kern | E21D 11/102 | |
| 2021/0231014 | A1 * | 7/2021 | Dai | E21D 11/102 | |
| 2021/0231015 | A1 * | 7/2021 | Dai | E21D 11/40 | |

* cited by examiner

WORK CARRIAGE FOR THE LINING OF TUNNELS

RELATED APPLICATIONS

This application is a National Phase of PCT Patent Application No. PCT/IB2023/051394 having International filing date of Feb. 16, 2023, which claims the benefit of priority of Italy Patent Application No. 102022000003116 filed on Feb. 21, 2022. The contents of the above applications are all incorporated by reference as if fully set forth herein in their entirety.

FIELD OF THE INVENTION

The present invention relates to an innovative work carriage and method for lining tunnels.

Here the term "tunnel" will mean accessible tunnels, e.g., rail or road tunnels, as well as pipelines for transporting for example fluids, such as sewer pipes or the like, etc.

The lining may be either in a tunnel under construction or in an existing tunnel in which restoration or replacement of the existing lining is needed.

BACKGROUND OF THE INVENTION

Various methodologies have been proposed in the prior art for creating the structural lining of tunnels. For example, it has been proposed to make reinforcements which are shaped like the tunnel vaults and into which concrete is fed. Once the lining has solidified, the reinforcements are then disassembled and removed; in the case of tunnels of a certain length, however, a large amount of reinforcements and considerable time are required for their assembly and disassembly. To reduce the need for large amounts of reinforcements, it has also been proposed to proceed in segments, with a work carriage proceeding along the tunnel to make successive segments of the lining by means of sliding formworks.

A critical part of said systems is that of the sliding of the formworks after the solidification, even only partial, of the lining segment. In fact, the sliding may be hindered by the adhesiveness of the material that makes up the lining. Therefore, an attempt is made to make the surface of the formwork in contact with the lining as smooth as possible. However, repeated sliding of the formworks against the surface of the material may lead to their rapid surface degradation, which further increases the sliding problems by being an additional source of friction.

It is therefore not unusual for friction to increase to the point of preventing proper sliding of the formworks, which stops the entire work carriage and requires long and costly disassembly, repair, or replacement and reassembly operations, also with very high downtime and costs.

SUMMARY OF THE INVENTION

The general object of the present invention is to provide a work carriage that normally allows for excellent sliding and also allows for limited downtime and relatively low restoration costs in the event of obstacles to the sliding.

In view of this object it is conceived to construct, according to the invention, a work carriage intended to pass stepwise along a tunnel to lay a solidifiable fluid material on the walls of the tunnel and allow it to solidify to form a tunnel lining, the carriage comprising a sliding formwork having an outer surface with the shape of the lining desired on the walls of the tunnel and having a closing board intended to close, radially to the tunnel, the space between a front edge of the sliding formwork and the wall of the tunnel to form an interspace which is between the formwork and the wall of the tunnel and which is intended to accommodate the solidifiable fluid material against the wall of the tunnel, characterized in that the formwork comprises ports for dispensing the solidifiable fluid material and is equipped with a covering mantle intended to make a surface of the interspace that is parallel to the advancement direction of the carriage along a tunnel, there being a releasable constraint between the formwork and covering mantle in order to be able to change from a first condition, in which the covering mantle is fixed to the formwork, to a second condition, in which the covering mantle slides over the formwork.

Also according to the invention, it has been conceived to devise a method for making a tunnel lining with a solidifiable fluid material by means of a sliding formwork with a covering mantle above the formwork and releasable from the formwork, comprising at least the steps of:

a) positioning the formwork along the tunnel to form an interspace between the formwork and the wall of the tunnel to be lined;
b) introducing the solidifiable fluid material into said interspace;
c) waiting for an established time period for the solidification of the solidifiable fluid material;
d) advancing the sliding formwork one step into the tunnel to form, with the formwork, a new interspace that is confined at the rear by the solidifiable fluid material introduced in the previous interspace (16) in step b);
e) repeating steps b) to d) to make subsequent segments of tunnel lining, and, if the resistance to the advancement of the formwork exceeds a predetermined value,
f) releasing the covering mantle from the formwork and advancing or retracting the formwork to expose the covering mantle for maintenance.

BRIEF DESCRIPTION OF THE FIGURES

In order to render the explanation of the innovative principles of the present invention and its advantages over the prior art clearer, illustrative embodiments applying these principles will be described below with the aid of the attached drawings. In the drawings.

DETAILED DESCRIPTION

Figure 1:
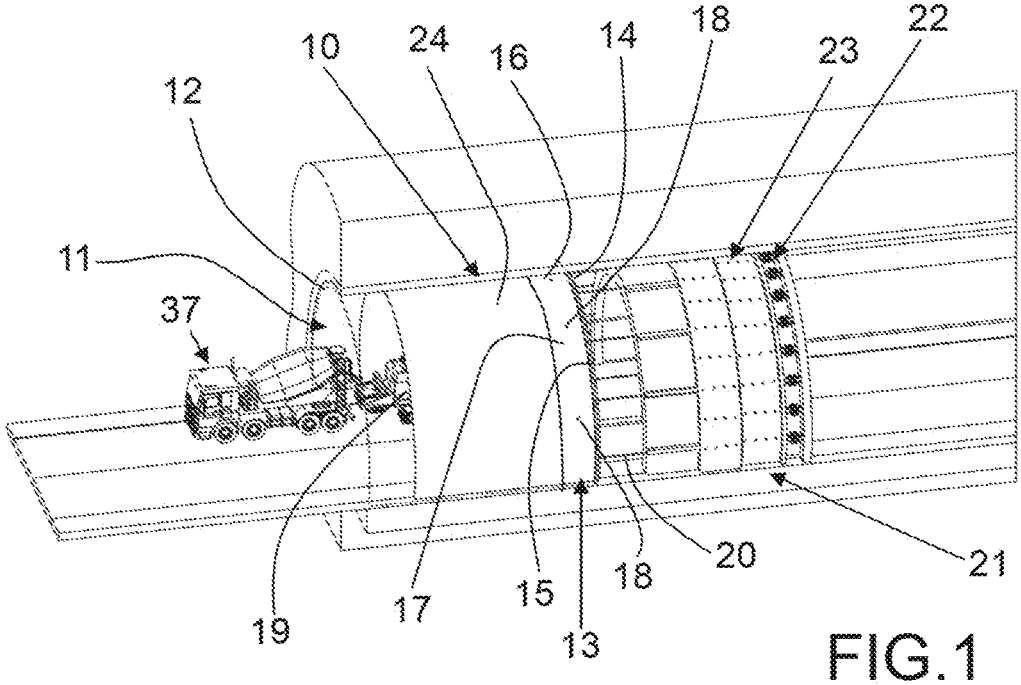
FIG. 1 is a schematic, partial perspective view of an example of a work carriage applying the principles of the invention.

With reference to the figures, an example of a possible work carriage, denoted generically by 10, is shown in FIG. 1.

The work carriage 10 is intended to run along a tunnel 11 to lay a solidifiable fluid material, for example concrete, with suitable known mechanical features on the tunnel walls and allow it to solidify, so as to make a lining 12 of the tunnel.

The work carriage 10 comprises a sliding formwork 13 with the side shape of the desired lining on the walls of the tunnel. For example, in the case of a vaulted tunnel (particularly but not exclusively a road or rail tunnel), the formwork may have a structure with a generically semicircular cross-section. The formwork 13 may be made in sections that may be assembled with each other, as will be clear in the following.

The carriage 10 also comprises a known advancement system (not shown in detail), which may also be automated, for moving stepwise along a tunnel. The known advancement system may also depend on the type of tunnel. For example, in the case where there is a floor that may be traversed by wheeled systems, the carriage may comprise an appropriate number of wheels. In particular, the carriage will be able, in its interior, to leave a central pathway free, in order to still allow the passage through the tunnel for operations required by the work (e.g., removal of excavated material by bulldozers and trucks) or, if necessary or preferable, for the safe movement of road or rail traffic. For example, the carriage may have an arched section.

The outer surface of the sliding formwork 13 has the shape of the lining desired on the walls of the tunnel and is equipped with a front closing board 14 that is intended to close, radially to the tunnel, the space between a front edge 15 of the sliding formwork 13 and the wall of the tunnel so that an interspace 16 is formed between the formwork and tunnel wall. The interspace 16 is intended to accommodate the solidifiable fluid material against the tunnel wall.

On its outer surface, the formwork 13 comprises ports 18 for dispensing the solidifiable fluid material and a covering mantle 17 that is intended to form the surface of the interspace that is parallel to the advancement direction of the carriage along a tunnel so as to face the wall of the tunnel to be lined.

As will become clear in the following, there is a releasable constraint between the formwork and the covering mantle in order to be able to move from a first condition, in which the covering mantle is fixed to the formwork at least in a direction that is parallel to the advancement direction of the carriage, to a second condition, in which the covering mantle slides over the formwork.

Preferably, the releasable constraint may be placed on the front edge of the formwork and the covering mantle. Still preferably, the constraint may be releasable from the front part of the formwork so that it may be operated from the free frontal area of the formwork.

For example, the dispensing ports 18 may be connected to a source 19 of this solidifiable fluid material in its fluid state. The source 19 will feed fluid on command with adequate pressure and flow rate to push it to fill the interspace 16 through the dispensing ports 18. For example, the source 19 may be filled at intervals by a concrete mixer 37 on a truck (or on another means of transport depending on the type of tunnel). The mixing of the raw materials (solid and liquid) that make up the fluid material may also be integrated into the work carriage.

During the use of the work carriage, it is possible to feed the solidifiable fluid material into the interspace 16 until it is filled to a desired degree (usually totally), and then wait for a determined solidification time (which may be understood as curing time and may also be only partial) and then advance the sliding formwork into the tunnel by one step (by means of known movement systems, e.g., also by gripping on the tunnel walls themselves) to form a new interspace that is confined at the rear by the solidifiable fluid material introduced in the previous step. Proceeding stepwise, the full extension of the desired lining along the tunnel may thus be obtained.

If desired or necessary, the work carriage may also comprise a front part or forecarriage 21 in front of the formwork. This front part 21 may also comprise a boring machine or a hydrodemolition machine 22 suitable for removing material from the tunnel wall before the passage of the formwork that constructs the lining of the wall with the solidifiable fluid material, and also sections 23, per se of a known type, for spraying for example waterproofing liquid toward the tunnel walls before the passage of the rear part that constructs the lining of the wall with the solidifiable fluid material.

The rear part and front part may be interconnected with each other in a fixed or movable way. For example, they may be connected to each other by suitable actuators (not shown, being per se easily conceived by the person skilled in the art) so that they may be mutually brought together and moved away on command in the stepwise advancement direction of the formwork to also obtain, at least partially, the advancement system of the carriage.

The board 14 may either be fixed on the formwork or be movable between an operational position against the front edge 15 of the formwork to form the front surface of the interspace 16, and a non-operational position that is away from the front edge of the formwork. The movement may be directed forward to open the interspace 16 at the front, or to the rear to facilitate a sliding operation, as will be described later.

Suitable actuators 20 (e.g., hydraulic pistons or electric gearmotors with linear mechanical transmission) may be present to move the board 14 between the various positions on command.

When the board is in its non-operational forward position, for example, a space may be created between the board and formwork in such a way that a known reinforcing mesh (not shown) may be prepared and introduced into the interspace to be incorporated into the solidifiable fluid material that is subsequently fed into the interspace. For example, the reinforcement may be formed as cages made of iron rods. This reinforcement may also be made in advance in suitable separate sections to be transported inside the work carriage and then assembled in the space between the board and formwork.

Advantageously, to introduce the reinforcement into the interspace 16, the reinforcement may be placed between the formwork 13 and the closing board 14 when the board is in its advanced, non-operational position, and then the closing board may be moved toward the operational position so that, in moving toward the closed position, it pushes the reinforcement toward and into the interspace.

The movement between the board and formwork may of course also be understood as a relative movement, that is, it may also be provided that the board remains stationary relative to the tunnel and it is the formwork that moves, for example, to advance and cover the reinforcement. This movement of the formwork relative to the board may be advantageous, for example, in case it is necessary to fix the reinforcement to the tunnel walls before embedding it in the fluid material.

The actuators for moving the closing board 14 between the operational and non-operational positions may also be connected between the board and formwork in addition to or as an alternative to the connection between the board and the front part of the work carriage.

To the rear of the formwork 13, structures 24 which are either integral to or independent of the formwork 13 may be provided to maintain a support of the lining even for a few steps of forward movement of the formwork forming the interspace, so as to ensure the complete curing of the lining even during a few steps of forward movement for forming sections of the lining. For example, these structures 24 may themselves be in the form of a sliding formwork that reproduces the shape of the outer surface of the lining produced with the formwork 13.

Figure 2:
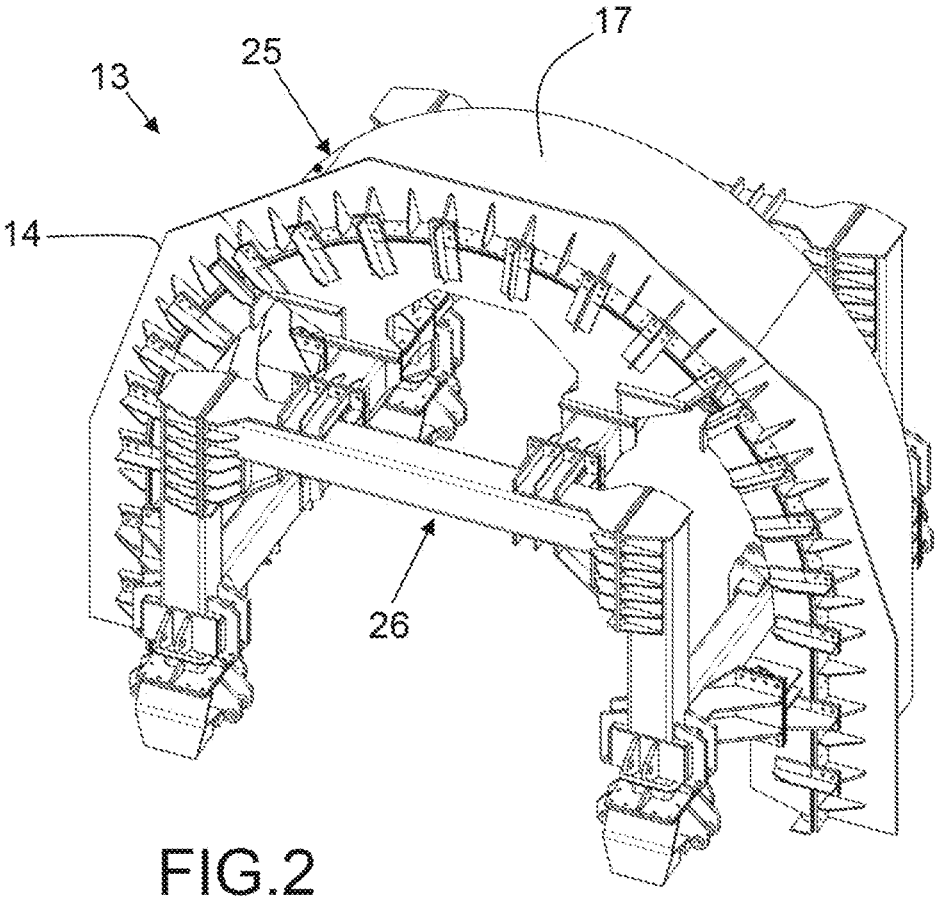
FIG. 2 is a schematic perspective view of a possible embodiment of a sliding formwork of the carriage according to the invention.

To further clarify the principles of the invention, a possible embodiment of the sliding formwork 13 is shown in FIG. 2.

Preferably, the formwork 13 may be formed of segments 25 assembled together in the circumferential direction of the tunnel to form the entire circumferential extension of the formwork 13. This may be convenient, for example, for formwork assembly and disassembly in the tunnel. For example, there may be three segments 25, including two side segments on the two sides of the tunnel and one positioned above that interconnects the two side elements. Of course, a different number of segments 25, even of different lengths, may be employed depending on practical needs, as will be easily conceived by the person skilled in the art based on the description given here. For example, the number and length of elements may depend on the size of the formwork and also on the willingness/need to have a section with variable geometry. At most, a single segment 25 may form the entire circumferential extension of the formwork.

As may still be seen in FIG. 2, the sliding formwork 13 may be supported by a frame 26 of the work carriage.

Figure 3:
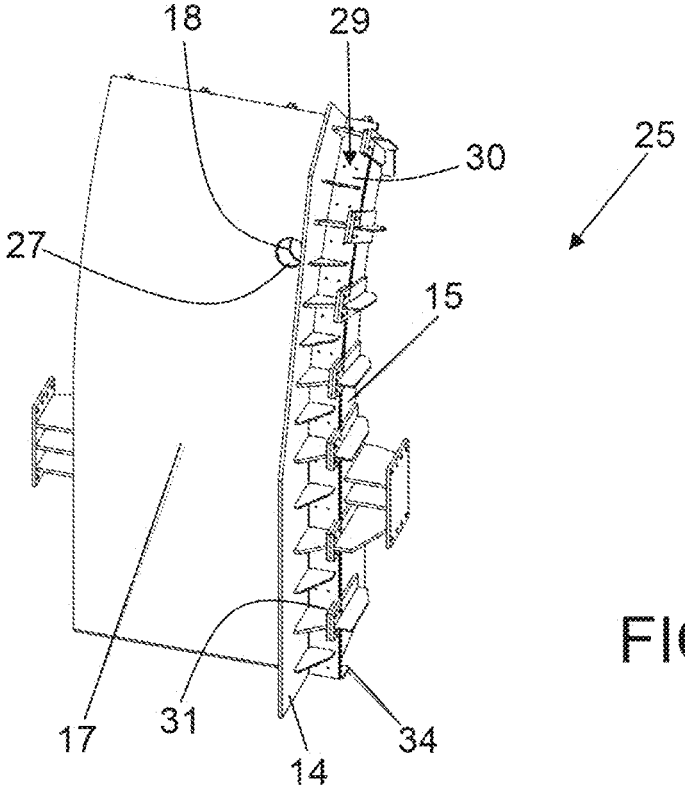
FIG. 3 is a schematic perspective view of a segment of the formwork in FIG. 2.

An example of a circumferential segment of the formwork 13 according to a first embodiment of the invention is shown in FIG. 3, where a possible embodiment of the covering mantle 17 is also shown. In FIG. 3, the mantle 17 is arranged in its operational position on the formwork to enter into contact with the fluid fed from the ports 18 into the interspace 16. Advantageously, the dispensing ports 18 are arranged at intervals along the circumferential extension of the formwork on the innermost surface of the interspace 16, and the covering mantle is equipped with holes 27 at the dispensing ports 18. The solidifiable fluid material may then be introduced into the interspace 16 through the covering mantle.

Figure 4:
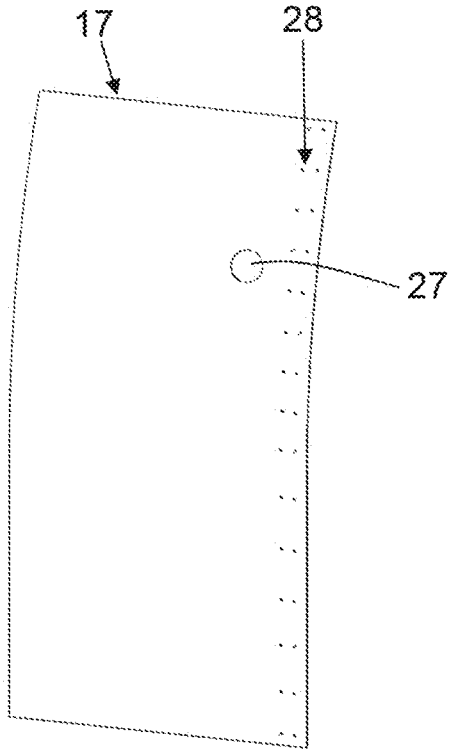
FIG. 4 is a schematic perspective view of a part of a covering mantle of the formwork in FIG. 2.

A possible embodiment of the covering mantle 17 removed from the formwork is shown in FIG. 4. Preferably, this mantle 17 may be made from a sheet of material (e.g., metal) that is sufficiently rigid at least in its plane of extension to maintain its shape when supported on the formwork frame and not distort due to its superficial scraping on the solidified surface of the tunnel lining. For example, the mantle 17 may be made from a metal sheet of suitable thickness.

The outer surface of the mantle 17 that is intended to enter into contact with the fluid in the interspace 16 may also be advantageously treated to be more anti-adherent and have an intentionally low sliding friction. For this purpose, it may be covered with a suitable anti-adherent layer and/or be machined to be smooth enough to provide sufficiently low sliding friction so as to serve the purposes that will be made clear below. For example, sheets of stainless steel (AISI 304, AISI 316, etc.) as well as various alloys, carbon steel with special paints, or others may be used, also depending on the effectiveness sought, the features of the solidifiable fluid material used, the environmental conditions, etc., as will be easily conceived by the person skilled in the art based on the description of the invention given here.

Again, as shown in FIGS. 3 and 4, the releasable constraint of the covering mantle 17 on the formwork 13 may be obtained with a releasable connection (e.g., by means of bolts) between the front edge of said covering mantle and the support frame of the formwork, possibly by means of said closing board.

In particular, the covering mantle 17 may, for example, comprise a series of holes 28 along its front edge to which the board 14 is attached. For example, the fastening may be achieved by means of tie-down bolts, so that the board may be removed from the mantle. For this purpose, the board 14 may comprise corresponding holes 29 on one of its base plates 30 which is parallel to the surface of the mantle and intended to be constrained on said mantle, e.g., by screws. The board 14 may also comprise elements 31 for its removable attachment against corresponding elements 32 arranged along the front edge of the formwork frame or the forecarriage, if any.

In its normal operating condition, shown in FIGS. 2 and 3, the board 14 is thus on the front edge of the formwork and also holds the mantle 17 in place so that it adequately covers the formwork to form the surface that delimits the interspace 16 facing the tunnel wall to be lined.

By releasing the connection between the board and the formwork or between the board and the mantle, the mantle may instead slide in a direction that is parallel to the advancement direction of the carriage.

The movement may be posterior or rearward, i.e., in a direction opposite to the advancement direction of the work carriage, or in the same direction, i.e., anterior or forward. For forward movement, the attachment of the board will be modified from that shown in the figures, for example to be on a lower plane than the formwork surface, so that the board may slide forward. Specifically, fastening elements 32 may be attached to the formwork frame in a removable manner or be provided in position below the formwork surface and with corresponding fastening elements 31 protruding radially below that surface so as to reach the fastening elements 32.

Figure 5:
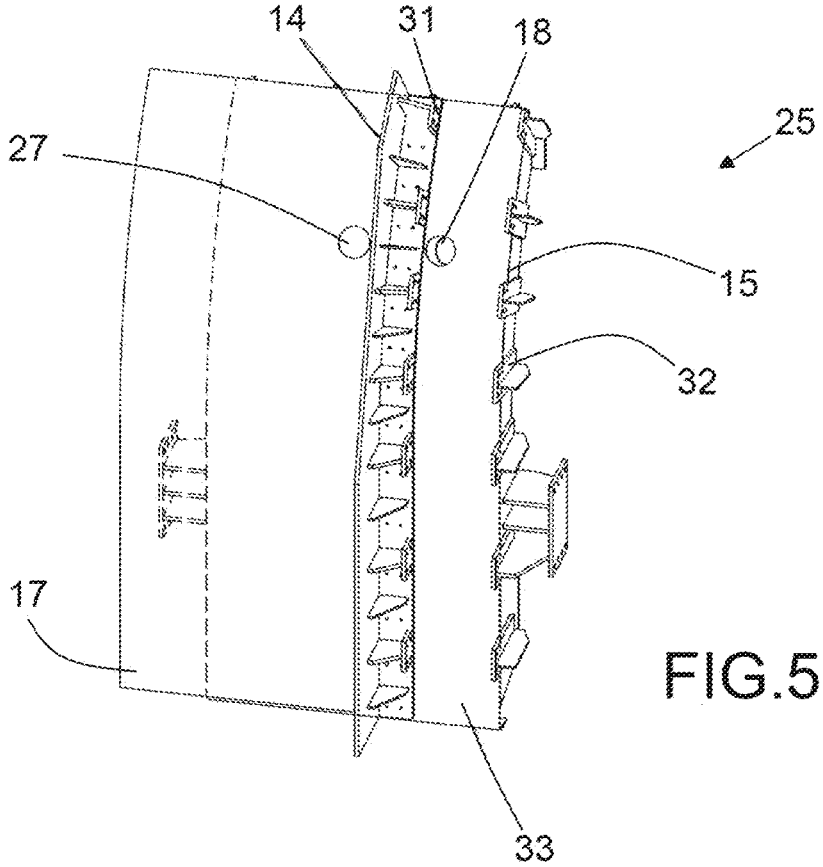
FIG. 5 is a view similar to that in FIG. 3, but under a different operating condition.

FIG. 5 shows by way of example the mantle moved backward after the release of the constraint means 31, 32.

The board may also advantageously slide more toward the rear edge of the formwork.

As may be seen in FIG. 5, the formwork may preferably comprise an outer surface 33 whereon the covering mantle 17 normally rests. Such a surface, kept rigid by the underlying formwork frame, allows for adequate rigidity of the covering mantle in the operational position, even when the mantle is made in the form of a very thin sheet.

The surface 33 also allows the covering mantle to slide easily over the formwork in the direction that is parallel to the advancement direction of the carriage. The surface 33 may be constructed, for example, from a metal sheet machined superficially to have suitably low friction against the surface of the covering mantle in contact therewith.

Figure 6:
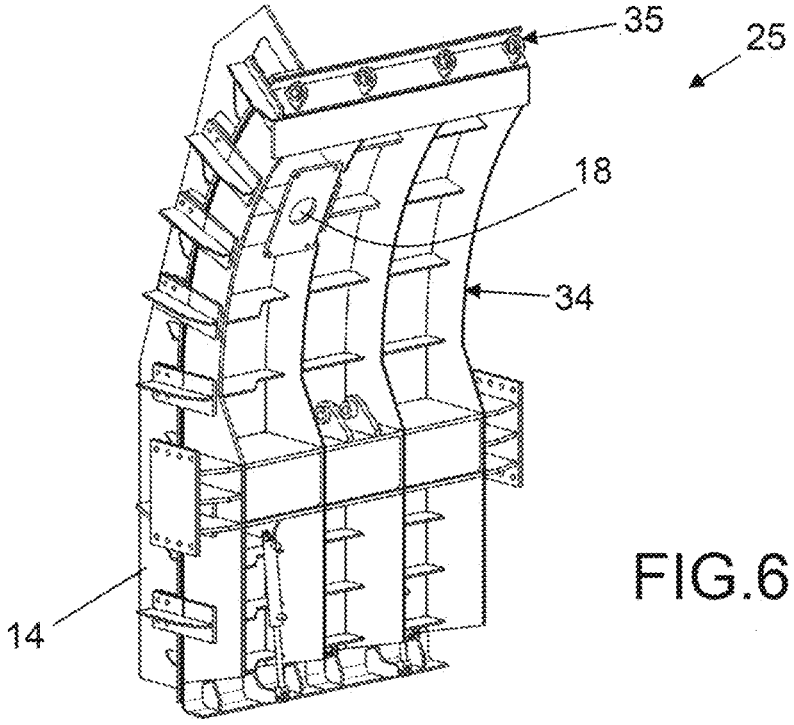
FIG. 6 is a schematic perspective view of the opposite face of the segment in FIG. 3.

In FIG. 6, a possible structure of the inner part of a segment 25 of the formwork 13 is shown. This structure may comprise a framework 34 consisting of spars and ribs of appropriate thickness that support the mantle, for example by means of a sheet that forms the outer surface 33, if any, and that are connected to the rest of the frame 26 of the work carriage.

This allows for strong and relatively lightweight formwork segments, as well as easy assembly and disassembly.

The rear ends of the dispensing ports 18 may face the inner side of the framework 34 for a connection to appropriate ducts (not shown) for supplying the solidifiable fluid.

As is seen again in FIG. 6, the segments 25 may comprise appropriate couplings 35 to form a removable connection to the other segments 25 forming the formwork 13. This connection may also be made to allow a hinged movement of the segments 25 relative to each other along an axis parallel to the axis of the tunnel, so that, for example, the formwork may be adapted to the shape of the tunnel vault.

Figure 7:
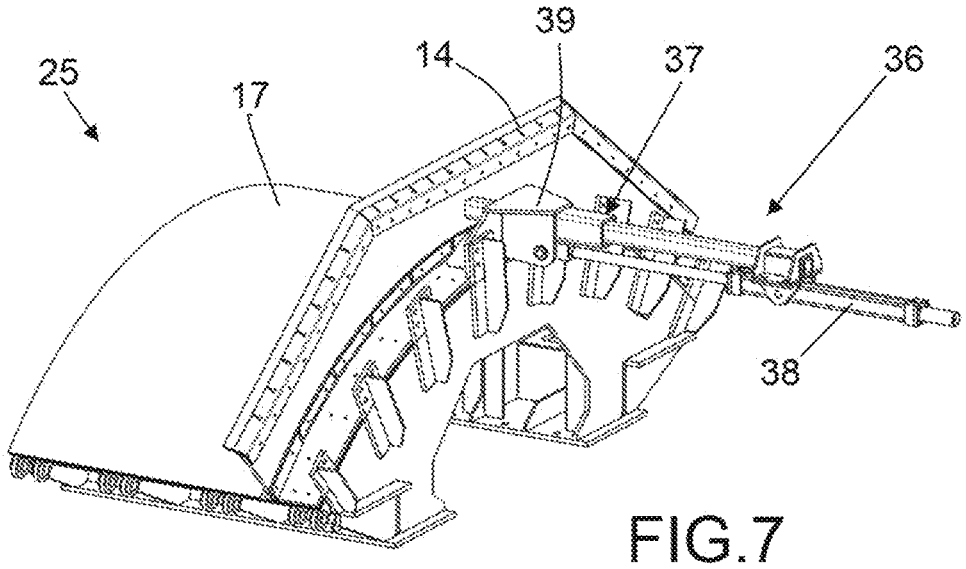
FIG. 7 through 9 show an alternative embodiment according to the invention of a segment of the formwork in FIG. 2 in different operational positions.
Figure 8:
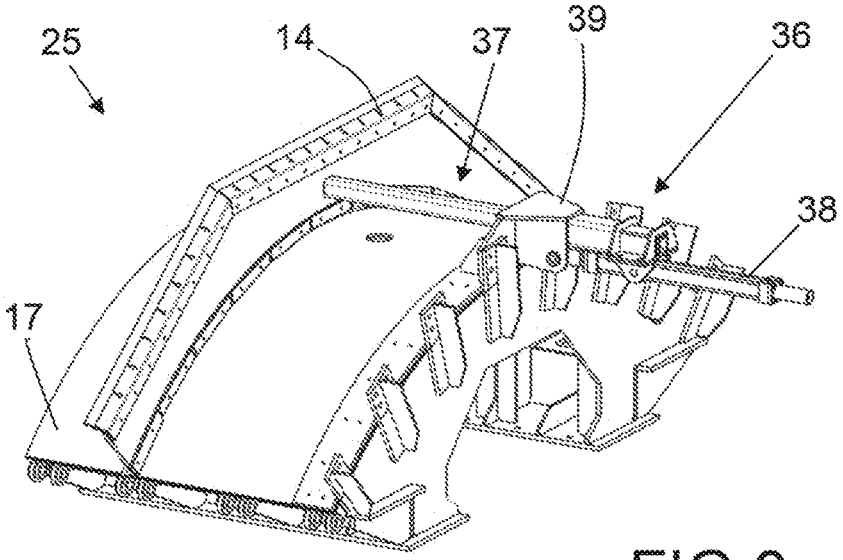
Figure 9:
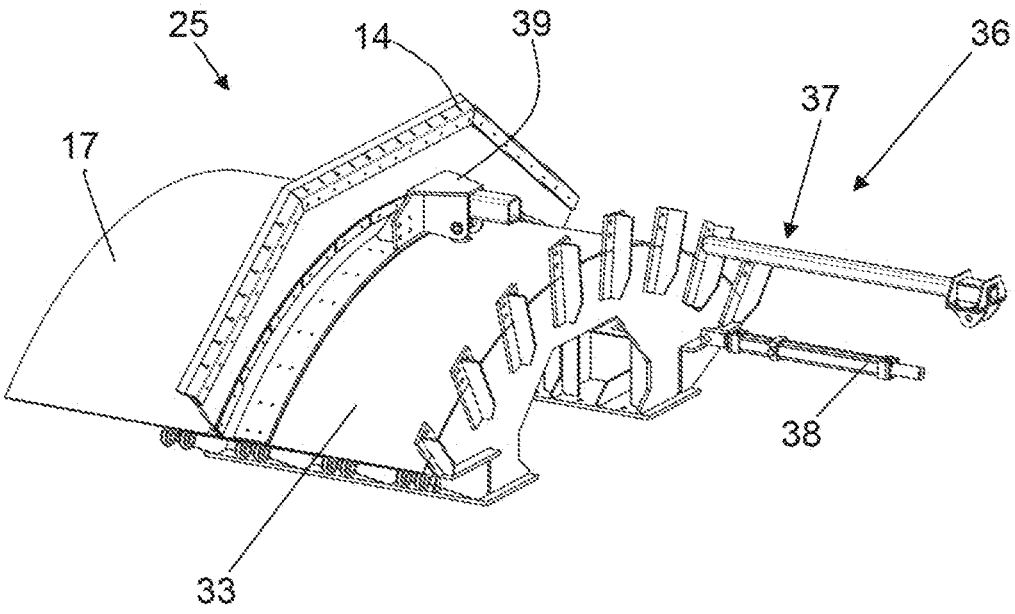

FIGS. 7, 8 and 9 show a possible alternative embodiment of the segments 25 of the formwork.

In this embodiment, the board 14 is connected to the formwork (or to the forecarriage, if present) by a motorized movement system 36 so that it is movable on command between its operational and non-operational positions, forward and/or backward relative to the formwork.

For example, FIG. 7 shows by way of example the motorized system 36 made with a double "male-female" tube 37 that is in turn connected to a hydraulic cylinder 38. Of course, the motorized system 36 could be a multiple motorized system, repeating at intervals the structure of the system 36 along the front periphery of the formwork.

In the configuration shown, the motorized system is mounted on the formwork, and therefore the board 14 may only move from the operational position in FIG. 7 to a rear non-operational position (shown in FIG. 8).

The motorized system is anchored to the formwork by means of a bracket 39.

Of course, by arranging for the motorized system to be anchored on the forecarriage, if present, as now easily conceived by the person skilled in the art, the board 14 could also be moved forward beyond the formwork, so as to open the interspace 16 for example for the introduction of reinforcement cages. The motorized system might then be arranged as schematically shown with 20 in FIG. 1.

The covering mantle may be connected to the formwork at a possible forecarriage to be slidable as described in the previous embodiment.

In addition or alternatively, it could also be movable on command through a motorized system, which may also be the same motorized system 37 made to be double-acting.

In FIG. 9, where for clarity' sake the movement system is shown partially broken down, the covering mantle is moved partially backward to reveal the sliding surface 33.

It is at this point clear how the objects of the invention have been achieved.

During normal operation of the work carriage for obtaining a tunnel lining, the formwork may be positioned along the tunnel to form the interspace 16 and then the solidifiable fluid material may be introduced to adequately fill the interspace.

After that, it is possible to wait for a predetermined time for solidification of the solidifiable fluid material. When solidification is deemed sufficient, the sliding formwork may be advanced one step into the tunnel to form, with the formwork, a new interspace 16 that is confined at the rear by the solidifiable fluid material fed into the previous interspace. This procedure may be repeated to make subsequent sections of tunnel lining until the lining is completed.

If the use of reinforcement cages is necessary, the board 14 may be made movable in the forward direction as described above, so that the cage is inserted into the interspace before the solidifiable fluid material is fed therein.

If at some point, for whatever reason, the resistance to the advancement of the formwork exceeds a predetermined value due to an adhesion of the lining material to the covering mantle, it is possible, according to the principles of the invention, to release the covering mantle from the formwork and advance the formwork while leaving the covering mantle behind for maintenance. The mantle may then be removed from the surface of the lining.

In this way, it is possible, for example, to restore the initial smoothness of the covering mantle, for example by restoring its surface or layer that slides against the solidified material, or even replacing the covering mantle left behind with another covering mantle that may be positioned and constrained over the formwork in place of the covering mantle left behind.

It is thus possible to avoid complete disassembly of the formwork, as is necessary with the systems of the prior art.

The mantle 17 may also be made as a wear mantle, meaning that during the normal advancement of the work carriage such a mantle is subject to the progressive wear effects produced by its sliding against the solidified coating. In this way, when it is worn beyond a predetermined amount, it may be easily removed and replaced. This keeps both the time and maintenance cost of the work carriage with the sliding formwork low.

This allows the useful life of the machinery to be increased and/or the maintenance costs to be reduced. In fact, in the prior art, the horizontal extrusion module is subject to significant friction and abrasion stresses that require frequent and costly maintenance.

With the solution according to the invention, these frictional and abrasion stresses are instead borne by the removable mantle. In this way, only the wear mantle may be replaced without affecting the main structure, when the surface of this wear mantle is deemed no longer suitable for use (e.g., because due to wear its smoothness along the solidified coating has dropped below a predetermined value).

Due to the use of a board that is movable backward on the covering mantle, it is also possible to keep the board fixed with respect to the tunnel while the formwork advances one step after the fluid material is fed into the interspace. In this way, the solidifiable fluid material may be prevented from being dragged forward along with the sliding formwork if this fluid material has not yet solidified sufficiently. This reduces the time between one advancement step and another.

Of course, the above description of embodiments applying the innovative principles of the present invention is given as an example of these innovative principles and should therefore not be taken as limiting the scope of the patent claimed herein.

For example, parts of the work carriage may be missing, added, or even duplicated depending on specific work needs. In addition, although figures have been shown where the tunnel has a vaulted section with a flat road bottom, the system may obviously also be used with railway tunnels, or even in tunnels with a generically circular cross-section, such as tunnels for conveying water (e.g., hydroelectric power plants), urban sewer systems, large sewers, etc., as is now clear to the person skilled in the art based on the description of the invention given here.

Moreover, if it is not necessary to remove an existing lining, the new lining may be produced directly against the existing lining to cover it with the new one.

As mentioned above, in order to expose the covering mantle when it is desired to remove it from the formwork, the movement of the formwork may also be in the opposite direction from the stepwise advancement direction along the tunnel, so that the mantle is exposed in front of the formwork instead of behind it. The covering mantle may also be constrained to the formwork near its rear edge, in addition to or in place of the constraint along its front edge, or even constrained laterally.

Lastly, the advancement of the formwork and the front part may also be performed together, and the two parts may be pulled or pushed together, by means of suitable motorization or front and/or rear blocking and sliding means, as is easily conceived by the person skilled in the art.

What is claimed is:

1. A work carriage intended to run stepwise along a tunnel to lay a solidifiable fluid material on walls of the tunnel and allow the solidifiable fluid material to solidify for constructing a lining of the tunnel, the work carriage comprising:

a sliding formwork with an outer surface having a shape of the lining desired on the walls of the tunnel, the sliding formwork comprising a closing board for closing, radially to the tunnel, a space between a front edge of the sliding formwork and a wall of the tunnel to be lined to form an interspace between the sliding formwork and the wall of the tunnel which is intended to accommodate the solidifiable fluid material against the wall of the tunnel, wherein the sliding formwork further comprises dispensing ports for dispensing the solidifiable fluid material and a covering mantle intended to make a surface of the interspace that is parallel to an advancement direction of the work carriage along the tunnel, a releasable constraint being provided between the sliding formwork and the covering mantle in order to move from a first condition, in which the covering mantle is fixed to the sliding formwork, and a second condition, in which the covering mantle slides over the sliding formwork.

2. The work carriage of claim 1, wherein the releasable constraint is arranged on the front edge of the sliding formwork and the covering mantle.

3. The work carriage of claim 1, wherein the releasable constraint is formed by a releasable connection between an edge of the covering mantle and a framework supporting the sliding formwork.

4. The work carriage of claim 3, wherein the releasable connection is obtained by means of the closing board.

5. The work carriage of claim 1, wherein the covering mantle provides holes at the dispensing ports to allow the solidifiable fluid material to pass through the covering mantle and into the interspace.

6. The work carriage of claim 1, wherein the covering mantle is in the form of a metal sheet.

7. The work carriage of claim 1, wherein the sliding formwork is formed, at least at the covering mantle, with a plurality of interconnected segments.

8. The work carriage of claim 1, wherein the sliding formwork further comprises an outer surface, and wherein the covering mantle rests on the outer surface.

9. The work carriage of claim 1, wherein the closing board is movable between an operational position close to the front edge of the sliding formwork and a non-operational position away from the front edge of the sliding formwork to open said interspace or to move closer to a rear edge of the sliding formwork.

10. The work carriage of claim 9, wherein for a movement of the closing board between the operational and non-operational positions there are one or more motorized systems connected between the closing board and the sliding formwork or between the closing board and a front part of the work carriage that is placed in front of the sliding formwork in the advancement direction of the work carriage.

11. The work carriage of claim 10, wherein the front part comprises a boring machine or a hydrodemolition machine adapted to remove material from the wall of the tunnel, and/or sections for spraying waterproofing fluid toward the wall of the tunnel, before the sliding formwork passes through for lining the wall with the solidifiable fluid material.

12. A method for making a tunnel lining with a solidifiable fluid material by a sliding formwork with a covering mantle above the sliding formwork and releasable from the sliding formwork, the method comprising at least steps of:

a) positioning the sliding formwork along the tunnel to form an interspace between the sliding formwork and a wall of the tunnel to be lined;

b) introducing the solidifiable fluid material into said interspace;

c) waiting for an established time period for solidification of the solidifiable fluid material;

d) advancing the sliding formwork one step into the tunnel to form, with the sliding formwork, a new interspace that is confined at the rear by the solidifiable fluid material introduced in a previous interspace in step b);

e) repeating steps b) to d) to make subsequent segments of the tunnel lining, and, if a resistance to an advancement of the sliding formwork exceeds a predetermined value, f) releasing the covering mantle from the sliding formwork and advancing or retracting the sliding formwork to expose the covering mantle for maintenance.

13. The method of claim 12, wherein the maintenance comprises a step of replacing the exposed covering mantle with another covering mantle.

* * * * *